US007845181B2

(12) United States Patent
Evans et al.

(10) Patent No.: US 7,845,181 B2
(45) Date of Patent: Dec. 7, 2010

(54) ACTIVE MOISTURE CONTROL BARRIER AND ACTIVE HUMIDITY CONTROLLED SPACE

(75) Inventors: Phillip C. Evans, Haubstadt, IN (US); David L. Benefiel, Oakland City, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 1403 days.

(21) Appl. No.: 11/287,559

(22) Filed: Nov. 23, 2005

(65) Prior Publication Data

US 2007/0113565 A1 May 24, 2007

(51) Int. Cl.
*F25B 49/00* (2006.01)
*F25D 17/04* (2006.01)

(52) U.S. Cl. ..... 62/176.1; 62/441; 62/417

(58) Field of Classification Search ..... 62/176.1, 62/382, 417, 440, 441
See application file for complete search history.

(56) References Cited

U.S. PATENT DOCUMENTS

| | | | | |
|---|---|---|---|---|
| 4,788,832 | A | 12/1988 | Aoki et al. | 62/382 |
| 4,949,847 | A | 8/1990 | Nagata | 206/484.1 |
| 5,098,776 | A | 3/1992 | Kobayashi et al. | 428/283 |
| 5,139,832 | A | 8/1992 | Hayashi et al. | 428/35.5 |
| 5,918,480 | A | 7/1999 | Nagata et al. | 62/440 |
| 6,170,276 | B1 | 1/2001 | Mandel et al. | 62/187 |
| 6,223,553 | B1 | 5/2001 | Albert et al. | 62/407 |
| 6,343,477 | B1 | 2/2002 | Mandel et al. | 62/187 |
| 6,463,752 | B2 | 10/2002 | Mandel et al. | 62/382 |
| 7,059,664 | B2 * | 6/2006 | Aase et al. | 296/180.5 |
| 2003/0115892 | A1 * | 6/2003 | Fu et al. | 62/187 |

FOREIGN PATENT DOCUMENTS

JP 07328372 A * 12/1995

* cited by examiner

*Primary Examiner*—Chen-Wen Jiang
(74) *Attorney, Agent, or Firm*—John W. Morrison; Greer, Burns & Crain Ltd

(57) ABSTRACT

An active moisture control barrier is provided which comprises a layer of shape memory polymer and a heating arrangement associated with the layer of shape memory polymer. The barrier may be used to provide an active humidity controlled space having an enclosure with walls to separate an interior of the enclosure from an environment surrounding the enclosure. An opening in one of the walls allows communication between the interior of the enclosure with the environment. A layer of shape memory polymer is provided at the opening to isolate the interior of the enclosure from the environment. A control may be provided for the heating arrangement to allow for a heating of the layer to a level as controlled or set by a user. An air passage conduit may extend from the interior of the enclosure through a zone of relatively higher water vapor pressure. The air passage conduit may be formed, at least in part, of shape memory polymer to allow water vapor to migrate from the zone of relatively higher water vapor pressure into the interior of the enclosure thereby adding moisture into the enclosure.

18 Claims, 2 Drawing Sheets

ACTIVE MOISTURE CONTROL BARRIER AND ACTIVE HUMIDITY CONTROLLED SPACE

BACKGROUND OF THE INVENTION

In a refrigerator there typically are provided special drawers or compartments for food items, such as fresh vegetables, where some type of control is provided for adjusting the humidity within the drawer or compartment. Controlling the humidity level in a crisper drawer can lengthen a period of freshness of vegetables. Oftentimes the control is merely a simple slide on the drawer or compartment opening a window or aperture into the space to control the rate at which the humidity in the space will be allowed to dissipate into the remaining space of the refrigerator, which generally has a lower humidity, such as disclosed in U.S. Pat. No. 5,540,492. Othertimes the controls include absorbents and filters, however they do not actively raise the humidity levels in the controlled space, they only capture and control the current humidity levels already available in the environment. These controls are essentially passive in their attempt to control the humidity levels. The crisper drawers continue to lose their moisture level until that level becomes stabilized and in equilibrium with the rest of the refrigeration compartment.

Shape memory polymer is a material referred to herein and refers to a material such as that disclosed in U.S. Pat. Nos. 5,098,776 and 5,139,832.

Various refrigeration compartment constructions are disclosed using moisture permeable files for maintaining a desired humidity level within an enclosure in U.S. Pat. Nos. 6,170,276, 4,788,832, 4,949,847 and 5,918,480.

Other crisper drawer humidity control arrangements are disclosed in U.S. Pat. Nos. 6,463,752, 6,343,477 and 6,223,553.

It would be an advance in the art if there were provided a moisture control barrier that could be actively controlled to maintain a desired moisture level in an enclosure and to add humidity to an interior of the enclosure.

SUMMARY OF THE INVENTION

The present invention provides a moisture control barrier that is actively controlled to maintain a desired moisture level within an enclosure.

In an embodiment of the invention, an active moisture control barrier is provided which comprises a layer of shape memory polymer and a heating arrangement associated with the layer of shape memory polymer.

In an embodiment of the invention, an active humidity controlled space is provided comprising an enclosure having walls to separate an interior of the enclosure from an environment surrounding the enclosure. An opening in one of the walls allows communication between the interior of the enclosure with the environment. A layer of shape memory polymer is provided at the opening to isolate the interior of the enclosure from the environment. This may be done by having the layer of shape memory polymer extend across the opening to completely cover the opening. A heating arrangement may be associated with the layer of shape memory polymer. A control may be provided for the heating arrangement to allow for a heating of the layer to a level as controlled or set by a user.

In an embodiment of the invention, an active humidity controlled space is provided comprising an enclosure having walls to separate an interior of the enclosure from an environment surrounding the enclosure. An air passage conduit may extend from the interior of the enclosure through a zone of relatively higher water vapor pressure. The air passage conduit may be formed, at least in part, of shape memory polymer to allow water vapor to migrate from the zone of relatively higher water vapor pressure into the interior of the enclosure thereby adding moisture into the enclosure.

DETAILED DESCRIPTION OF THE PREFERRED EMBODIMENT

Many different types of enclosures could benefit from the present invention, and the invention is meant to be used in many different types of enclosures including storage spaces, spaces in which people are present, spaces containing mechanical or electrical working components, and other types of enclosed spaces. However, for purposes of disclosing the present invention, a specific type of enclosure, in the form of a crisper drawer used in a refrigeration appliance, is disclosed and shown. Such a particular showing is not meant, however, to foreclose the use of the present invention in other types of enclosures, both in refrigeration devices, such as a meat drawer, as well as in other appliances or locations where a particular level of humidity in the enclosure is desired to be maintained above a humidity level in an environment surrounding the enclosure.

Figure 1:
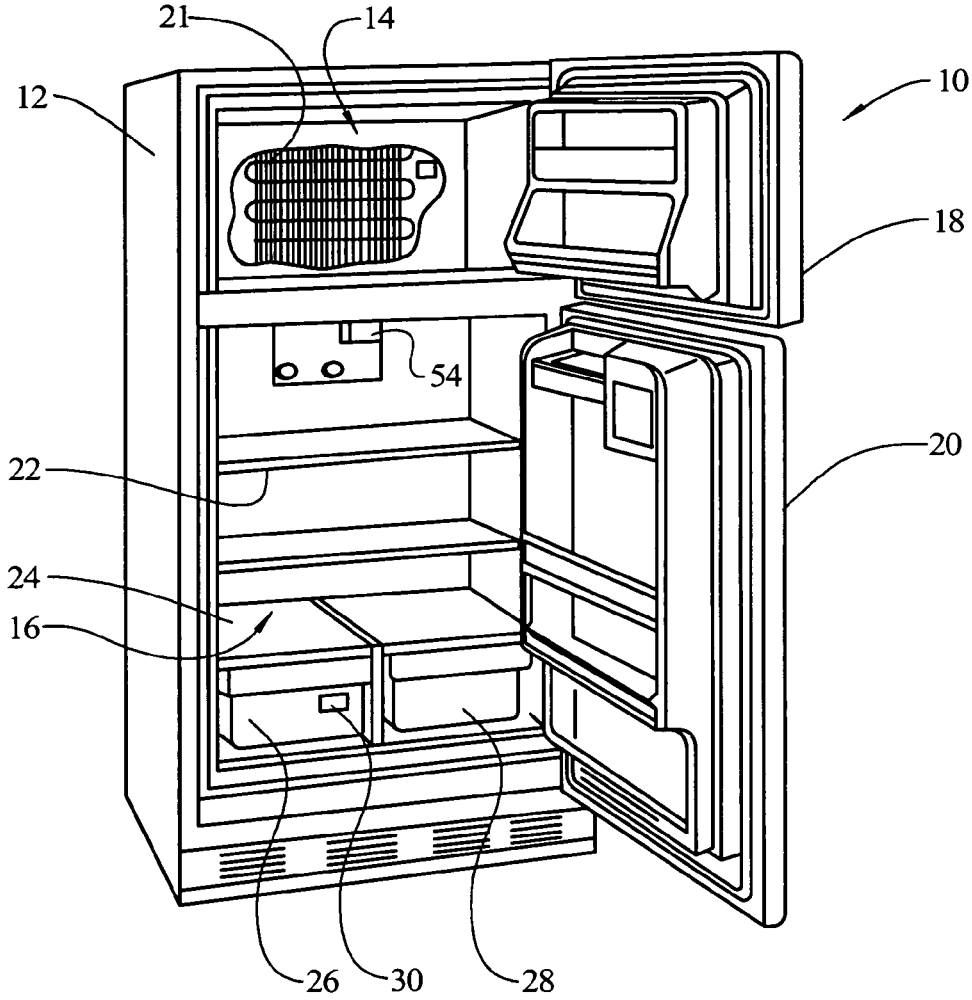
FIG. 1 illustrates a perspective view of a refrigeration appliance having a controlled humidity enclosure.

FIG. 1 illustrates an environment in which the present invention may be utilized. A refrigeration appliance, such as a combination refrigerator/freezer 10, is shown which includes a pan assembly or crisper drawer 26 with a humidity control 30 in accordance with the principles of the present invention. Although a refrigeration appliance having a top freezer compartment and a lower refrigeration compartment is shown, other types of refrigeration appliances might also be used in conjunction with the present invention, as will be obvious to those skilled in the art. Also, other types of enclosures may be used in conjunction with the present invention, separate and apart from refrigeration appliances.

The refrigerator/freezer 10 includes a cabinet 12 defining a below-freezing, or freezer compartment 14 and a fresh-food or above-freezing compartment 16. A freezer door 18 and a fresh-food compartment door 20 are provided for selective access to the freezer and fresh-food compartments 14, 16 respectively.

The freezer and fresh-food compartments 14, 16 are cooled by circulating air therethrough which has been refrigerated as a result of being passed in a heat exchange relation with a conventional evaporator 21. In addition to the evaporator, the refrigerator/freezer includes connected components (not shown) such as a compressor, a condenser, a condenser fan, and an evaporator fan as will be obvious and well known to those skilled in the art.

The fresh-food compartment 16 includes a plurality of upper shelves 22. Also provided in a fresh-food compartment is a lower shelf 24. In the preferred embodiment, the lower shelf is of solid construction and may be, for example, high strength glass or plastic.

A pair of storage pan assemblies or crisper drawers 26, 28 according to the invention are disposed within the fresh food compartment 16 below the lower shelf 24. The storage pans 26, 28 may be of similar construction. One of the storage pans, such as pan 26, should include a humidity control 30 thereon. If desired, both storage pans 26 and 28 could include a humidity control 30. A storage pan assembly 26 with the humidity control 30 provides a pan for the storage of food such as vegetables and provides means to actively control the moisture content of the storage pan assembly to preserve freshness of the vegetables and prevent them from being prematurely damaged.

Figure 3:
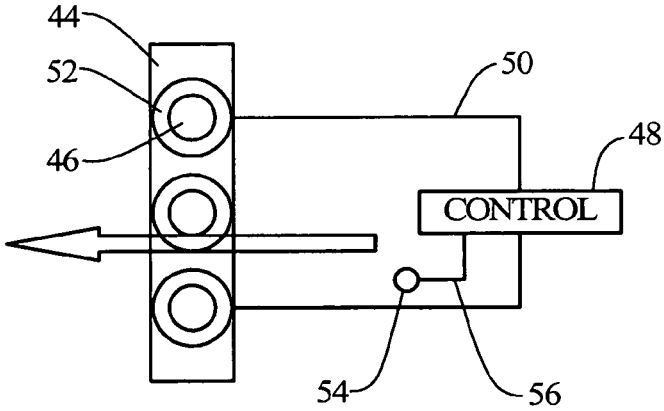
FIG. 3 illustrates a portion of a shape memory polymer layer in a cross section and a schematic connection to a control.
Figure 2:
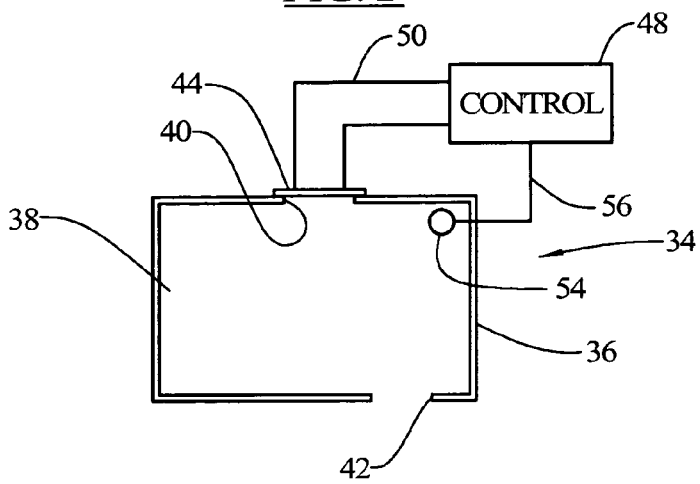
FIG. 2 schematically illustrates an enclosure in a cross section, embodying the principles of the present invention.
Figure 4:
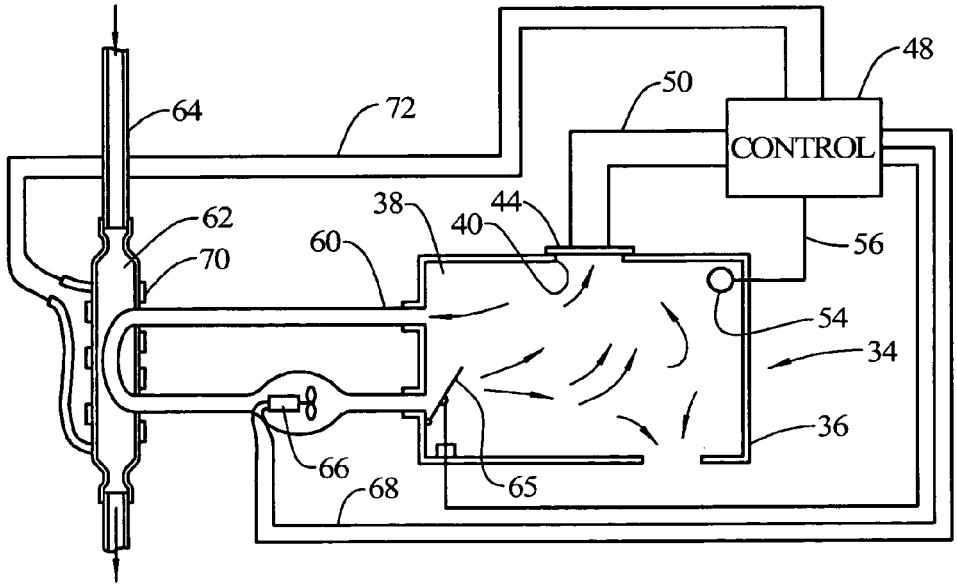
FIG. 4 schematically illustrates a cross section of an enclosure and an air passage conduit extending through a zone of relatively higher water vapor pressure.

As shown in FIGS. 1-4, the present invention provides an active humidity controlled space which may include an enclosure 34, such as the crisper drawer 26, having walls 36 to separate an interior 38 of the enclosure from an environment surrounding the enclosure. In the case of a crisper drawer 26, the environment surrounding the enclosure would be the refrigeration compartment 16, which typically has a relatively low humidity level. An opening 40 is provided in one of the walls 36 to allow communication between the interior 38 of the enclosure 34 and the environment. As illustrated in FIGS. 2 and 4, the enclosure 36 also has a second opening 42 which schematically represents leakage areas in the event the enclosure is not tightly sealed relative to its surrounding environment. This second opening 42 also represents the fact that the enclosure 34 is likely to be opened from time to time to place items into the enclosure and to remove items from the enclosure, thus allowing humidity to escape.

In an embodiment of the invention, a layer 44 of shape memory polymer may be provided as a barrier to isolate the interior of the enclosure from the environment by extending across the opening 40 to completely cover the opening. The dimensions of the opening 40 and the thickness of the layer 44 may be selected in accordance with the operating parameters of the enclosure 34 in which the humidity level is being controlled.

In an embodiment, as best seen in FIG. 3, a heating arrangement 46 is associated with the layer 44 of shape memory polymer, for example, by being embedded within the layer in the form of resistance wires. Other types of heating arrangements can be utilized including exteriorly applied resistance heaters, radiant heaters, and arrangements for directing a heated fluid into contact with the layer 44, as discussed below. The heating arrangement 46 is operated by means of a control 48 operatively connected to the heating arrangement. In the case where the heating arrangement 46 comprises resistance wires, the control 48, under operating instructions which may be provided by a user, would selectively provide an electric current to the heating arrangement via wires 50. The heating arrangement creates a zone 52 of elevated temperature in the layer 44 of shape memory polymer. By changing the temperature of the layer 44 of shape memory polymer, the moisture permeability of the layer is changed. That is, as the temperature is increased, the moisture permeability increases. In this manner, the user can select a permeability level for the layer of shape memory polymer 44, and hence a rate of moisture flow through the first opening 40, thereby selectively controlling the moisture level within the enclosure 34.

In an embodiment of the invention, an active moisture control barrier is provided comprising the layer 44 of shape memory polymer and the heating arrangement 46 associated with the layer of shape memory polymer. This barrier can be used in a variety of applications where humidity or moisture is to be controlled between two spaces, in addition to the particular embodiment illustrated in a refrigerator crisper drawer. This arrangement can be used to selectively decrease the humidity level within the enclosed space, or to selectively increase the humidity level in the enclosed space.

In an embodiment, a humidity sensor 54 may be located within the space and operatively connected to the control 48 by means of wires 56 or by other means, such as via a wireless communication device. The user may set the control 48 to maintain a certain humidity level, and the humidity sensor 54 would detect the humidity level within the enclosure 34. If the detected humidity level is above that selected by the user, the control 48 would operate to energize the heating arrangement 46 to increase the permeability of the layer of shape memory polymer 44, allowing the humidity to migrate out through the layer of shape memory polymer to an environment having a lower humidity, and causing the humidity within the enclosure to drop. When the sensor 54 detects that the humidity level has reached the user selected level, the control 48 would deenergize the heating arrangement 46, decreasing the permeability of the layer of shape memory polymer 44, thereby retaining the humidity level within the enclosure. In this manner, the humidity level within the enclosure 34 is actively controlled. As an example, it is desirable to allow the humidity level within an enclosure such as a vegetable crisper drawer to be decreased from higher than desired levels when vegetables are first placed in the drawer in order to avoid dew build up on the vegetables.

In an embodiment, as illustrated in FIG. 4, an active humidity controlled space is provided with the enclosure 34 having walls 36 to separate the interior 38 of the enclosure from the environment surrounding the enclosure as described above. In this embodiment, an air passage conduit 60 extends from the interior 38 of the enclosure 34 through a zone 62 of water vapor pressure which is relatively higher than the water vapor pressure in the interior of the enclosure. As an example, the zone 62 might be the interior of a water supply line 64 present in some refrigeration appliances for supplying water to an automatic ice maker or to a chilled water dispenser. In such an example, the air passage conduit 60 would be completely submerged in liquid water. In other arrangements, the conduit 60 might not be submerged in liquid water, but may merely pass through an area having increased water vapor pressure in a gaseous form. As an example, the air passage conduit 60 may be placed in an area such as the condensation tray for the evaporator, which typically has an elevated moisture or humidity level. In other environments and applications, there may be other sources of water vapor, such as in an automobile, there are containers with aqueous solutions, such as in the coolant system or in the washer fluid system, and the shape memory polymer would be useful in allowing the smaller sized water molecules to pass through its walls, while preventing the larger molecules in those solutions, from entering the interior of the air passage conduit 60.

The air passage conduit 60 may be formed, at least in part, of shape memory polymer to allow water vapor to migrate from the zone 62 of relatively higher water vapor pressure into the interior 38 of the enclosure 34. Since the partial pressure of water molecules is lower in the interior 38 of the enclosure 34 than in the air passage conduit 60 located within the zone 62, water molecules will naturally migrate from the zone into the interior of the enclosure without further steps or effort required. A property of shape memory polymer is that as the humidity increases in the area of the polymer, the thermal motion of the polymer molecular chains becomes activated so it becomes easy for water molecules to penetrate the spaces that occur in the polymer. When the polymer is exposed to liquid water, the humidity level is 100%, thereby increasing the permeability of the polymer. In this arrangement, water molecules will continuously be added to the interior 38 of the enclosure 34, thereby making up any loss of moisture through the first 40 or second 42 openings in the enclosure. The shape memory polymer generally allows water molecules (0.35 nm) to pass through the material, however prevents large molecules such as bacteria (200 nm) from passing through. Thus, only clean water vapor will be introduced into the interior 38 of the enclosure 34.

In those applications where the air passage conduit 60 may be positioned in an area having a high humidity level, such as being submerged in liquid water, and therefore the shape memory polymer will be more permeable to the passage of water molecules, it may be desirable to provide a mechanical or electromechanical valve 65, such as a movable door, associated with the air passage conduit to selectively prevent the passage of water vapor into the interior of the enclosure 34 when the moisture level in the enclosure reaches a desired level. This will prevent the continuous entry of additional water molecules into the enclosure when they are no longer desired. The valve 65 may be operated by the control 48, and its operation may be affected by the humidity sensor 54.

To increase the rate of increase of moisture into the interior 38 of the enclosure 34, additional control elements may be provided. For example, an air moving device 66 may be provided, such as within the air passage conduit 60, which can be operatively connected to the control 48 by means of wires 68. By increasing the flow of air through the air passage conduit 60, the rate of moisture addition to the interior of the enclosure can be increased. Thus, for example, if the moisture sensor 54 detects that the moisture level within the interior 38 of the enclosure 34 is below that desired by the user, the control 48 can energize the air moving device 66 to increase the rate of addition of water vapor into the interior of the enclosure. Other air moving device arrangements may be utilized, including using the air power from the evaporator fan (in a refrigeration appliance) along with appropriate conduits and damper doors, to move the make-up humidified air.

Also or alternatively, a heating arrangement 70 may be provided in association with the zone 62, which can be operatively connected to the control 48 by means of wires 72 or another communication arrangement. When the sensor 54 detects that the moisture level within the interior 38 of the enclosure 34 is below that desired by the user, this heating arrangement may be used to increase a temperature of the water vapor (including liquid water) within the zone 62 or may be used to directly increase a temperature of the shape memory polymer of the air passage conduit 60 extending through the zone, such as by embedding heating elements within the conduit as described above with respect to the layer 44. By increasing the temperature, the moisture permeability of the shape memory polymer of the air passage conduit 60 will be increased, thus increasing the rate of addition of water vapor into the interior 38 of the enclosure 34.

If the zone 62 is located in a water feed line, in an embodiment, it may be located on a high pressure side of the line, that is, upstream of a flow valve, in which case the water vapor transmission rate could be increased. The zone 62 could be positioned downstream of a water filter so that the water in the zone is cleaner, thereby enhancing the transmission rate, and reducing the likelihood of fouling of the shape memory polymer area of the air passage conduit 60. A surface area of the air passage conduit 60 formed of shape memory polymer, and exposed to the zone 62 of increased water vapor pressure can be selected for a particular embodiment of the invention to control the water vapor transmission rate into a particular enclosure 34. The greater the exposed surface area, the greater the rate of water vapor transmission that can be achieved. One method of increasing the surface area would be to provide multiple conduits 60 in the zone 62 which are exposed to the higher water vapor pressure rather than a single conduit as schematically illustrated.

As an alternative to utilizing a moisture sensor 54, in the embodiment of FIG. 4, the air moving device 66 and/or heater 70 could be energized by the control 48 on a time basis, which may be variable based upon the user's moisture level selection at the control, thereby providing periodic additions to the moisture level within the enclosure 34. Such an arrangement could avoid the utilization of a moisture sensor altogether. On the other hand, a second moisture sensor may be located within the air passage conduit 60 to monitor a level of water vapor therein, for use in further controlling the operation of the air moving device 66 and/or the heating arrangement 70.

As an alternative to utilizing the layer 44 of shape memory polymer and the first opening 40 in the enclosure wall 36, a section 74 of the air passage conduit 60 which is exposed to the environment surrounding the enclosure 34, and yet which isolates the interior 38 of the enclosure from the environment, may be made of shape memory polymer to allow moisture to migrate out of the air passage conduit 60, and hence from the interior of the enclosure 34 when the environment surrounding this section 74 is at a lower humidity level than the interior of the enclosure. A temperature of this section 74 of the air passage conduit 60 may be controlled as discussed above with respect to the layer 44 to actively control the permeability of the section to water vapor.

Since the present invention allows for moisture to be added to an enclosure 34 to make up moisture loss to the environment surrounding the enclosure, the enclose no longer needs to be sealed as tightly relative to its environment as before. In the case of refrigerator crisper drawers 26, 28, special seals no longer need to be provided, allowing the drawers to be opened more easily. This further lowers the cost of manufacture since complete drawer assemblies would not need to be well sealed.

Although the moisture barrier, shown in the form of the layer 44 or the conduit 60, is disclosed as being used in a wall 36 of an enclosure 34, it could also be used in other locations where the transmission of moisture from one area to another is to be controlled. The permeability of the barrier may be controlled, as described above, through the use of a heating arrangement, such as heating elements embedded in the shape memory polymer forming the barrier and a control may be provided to selectively energize the heating arrangement.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An active humidity controlled space in a refrigeration appliance comprising:

a crisper drawer having walls to separate an interior of said drawer from a refrigerated environment surrounding said drawer, an opening in one of said walls to allow communication between said interior of said drawer with said environment, a layer of shape memory polymer at said opening to isolate said interior of said drawer from said environment, heating elements embedded in said layer of shape memory polymer, a humidity sensor located within said drawer, and a control operatively connected to said humidity sensor and said heating elements to allow for a heating of said layer to a level as controlled by a user, wherein said control is operative to cause a heating of said shape memory polymer when said humidity sensor detects a humidity level within said drawer above a predetermined desired humidity level.

2. An active humidity controlled space comprising:

an enclosure having walls to separate an interior of said enclosure from an environment surrounding said enclosure, an opening in one of said walls to allow communication between said interior of said enclosure with said environment, a layer of shape memory polymer at said opening to isolate said interior of said enclosure from said environment, a heating arrangement associated with said layer of shape memory polymer, and a control for said heating arrangement to allow for a heating of said layer to a level as controlled by a user, wherein said enclosure comprises a crisper drawer in a refrigeration appliance.

3. An active humidity controlled space comprising:

an enclosure having walls to separate an interior of said enclosure from an environment surrounding said enclosure, an opening in one of said walls to allow communication between said interior of said enclosure with said environment, a layer of shape memory polymer at said opening to isolate said interior of said enclosure from said environment, a heating arrangement associated with said layer of shape memory polymer, and a control for said heating arrangement to allow for a heating of said layer to a level as controlled by a user, an air passage conduit extending from said interior of said enclosure through a zone of relatively higher water vapor pressure, said air passage conduit being formed at least in part of shape memory polymer to allow water vapor to migrate from said zone of relatively higher water vapor pressure into said interior of said enclosure.

4. An active humidity controlled space according to claim 3, wherein an air moving device is arranged to increase an air flow through said air passage conduit.

5. An active humidity controlled space according to claim 3, wherein said zone of relatively higher water vapor pressure comprises an interior of a water line.

6. An active humidity controlled space according to claim 5, wherein a heating element is arranged at said water line to heat water in said water line at least in a zone through which said air passage conduit extends.

7. An active humidity controlled space according to claim 3, wherein said heating arrangement comprises embedded heating elements in said layer of shape memory polymer.

8. An active humidity controlled space according to claim 3, further including a humidity sensor located within said enclosure and operatively connected to said control.

9. An active humidity controlled space according to claim 8, wherein said control is operative to cause a heating of said shape memory polymer when said humidity sensor detects a humidity level within said enclosure above a predetermined desired humidity level.

10. An active humidity controlled space according to claim 3, wherein said enclosure comprises a crisper drawer in a refrigeration appliance.

11. An active humidity controlled space comprising:

an enclosure having walls to separate an interior of said enclosure from an environment surrounding said enclosure, an air passage conduit extending from said interior of said enclosure through a zone of relatively higher water vapor pressure, said air passage conduit being formed at least in part of shape memory polymer to allow water vapor to migrate from said zone of relatively higher water vapor pressure into said interior of said enclosure.

12. An active humidity controlled space according to claim 11, wherein an air moving device is arranged to increase an air flow through said air passage conduit.

13. An active humidity controlled space according to claim 11, wherein said zone of relatively higher water vapor pressure comprises an interior of a water line.

14. An active humidity controlled space according to claim 13, wherein a heating element is arranged at said water line to heat water in said water line at least in a zone through which said air passage conduit extends.

15. An active humidity controlled space according to claim 11, further including a humidity sensor located within said enclosure and operatively connected to a control.

16. An active humidity controlled space according to claim 15, wherein an air moving device is arranged to increase an air flow through said air passage conduit.

17. An active humidity controlled space according to claim 16, further including a control for said air moving device operative to cause operation of said air moving device when said humidity sensor detects a humidity level within said enclosure below a predetermined desired humidity level.

18. An active humidity controlled space according to claim 11, wherein said enclosure comprises a crisper drawer in a refrigeration appliance.

* * * * *